US008512170B2

(12) United States Patent
Muscarello

(10) Patent No.: US 8,512,170 B2
(45) Date of Patent: Aug. 20, 2013

(54) BALL MARKINGS FOR ROTATION TRAINING

(76) Inventor: Stephen G. Muscarello, Fox River Grove, IL (US)

( * ) Notice: Subject to any disclaimer, the term of this patent is extended or adjusted under 35 U.S.C. 154(b) by 121 days.

(21) Appl. No.: 13/069,110

(22) Filed: Mar. 22, 2011

(65) Prior Publication Data

US 2012/0244962 A1 Sep. 27, 2012

(51) Int. Cl.
*A63B 69/00* (2006.01)
*A63B 39/08* (2006.01)

(52) U.S. Cl.
USPC ..... 473/451; 473/422

(58) Field of Classification Search
USPC ..... 473/422, 451, 450, 458, 464, 598, 473/600; D21/713, 714
See application file for complete search history.

(56) References Cited

U.S. PATENT DOCUMENTS

| | | | | | |
|---|---|---|---|---|---|
| 50,652 | A | * | 10/1865 | Eddy | 402/25 |
| 465,507 | A | * | 12/1891 | Windoes | 473/600 |
| 676,506 | A | * | 6/1901 | Knight et al. | 473/268 |
| D50,652 | S | * | 4/1917 | Eddy | D21/714 |
| 2,776,139 | A | * | 1/1957 | Blamey, Jr et al. | 473/613 |
| 2,925,273 | A | * | 2/1960 | Pratt | 473/451 |
| 3,976,295 | A | * | 8/1976 | Heald, Jr. | 473/598 |
| 4,170,352 | A | * | 10/1979 | Vcala | 473/459 |
| 4,235,441 | A | * | 11/1980 | Ciccarello | 473/267 |
| 4,256,304 | A | * | 3/1981 | Smith et al. | 473/451 |
| 4,261,565 | A | * | 4/1981 | Massino, Sr. | 473/598 |
| 4,345,759 | A | * | 8/1982 | Nims | 473/569 |
| D288,461 | S | * | 2/1987 | Hirai | D21/713 |
| D288,462 | S | * | 2/1987 | Hirai | D21/713 |
| 4,874,169 | A | * | 10/1989 | Litchfield | 473/613 |
| 4,919,422 | A | * | 4/1990 | Ma | 473/613 |
| 4,991,838 | A | | 2/1991 | Groves | |
| 5,280,906 | A | * | 1/1994 | Vitale | 473/613 |
| 5,588,648 | A | * | 12/1996 | Stebbins | 473/451 |
| 5,603,497 | A | * | 2/1997 | Louez | 473/609 |
| 5,607,152 | A | * | 3/1997 | Strassburger | 473/451 |
| 5,711,725 | A | * | 1/1998 | Bengtson | 473/451 |
| 5,820,495 | A | * | 10/1998 | Howland | 473/451 |
| 5,893,806 | A | * | 4/1999 | Martinez | 473/447 |
| 5,984,813 | A | * | 11/1999 | Cinnella | 473/613 |
| D434,816 | S | * | 12/2000 | Jobst | D21/713 |
| 6,261,197 | B1 | * | 7/2001 | Grechko | 473/598 |
| 6,612,942 | B1 | * | 9/2003 | Battersby et al. | 473/451 |
| 7,048,656 | B2 | * | 5/2006 | Litchfield | 473/598 |
| 7,059,862 | B2 | * | 6/2006 | McGinley | 434/247 |
| D600,757 | S | * | 9/2009 | Boyan | D21/714 |
| 7,608,003 | B1 | * | 10/2009 | Fusco et al. | 473/613 |
| 7,753,811 | B2 | * | 7/2010 | Mark | 473/422 |
| D648,406 | S | * | 11/2011 | Hochberg | D21/713 |
| 8,075,431 | B2 | * | 12/2011 | Smith et al. | 473/604 |

* cited by examiner

*Primary Examiner* — Mitra Aryanpour
(74) *Attorney, Agent, or Firm* — Lempia Summerfield Katz LLC

(57) ABSTRACT

Balls are provided to train someone to throw with proper rotation. A marking is positioned on the ball to enhance viewing of rotation. The marking is in a contrasting color than the rest of the cover and covers at least a quarter of the outer surface of the ball. The stitches are colored to avoid interfering with the visual effect of the marking, such as having stitches with similar coloration to the non-marking portion of the ball. Balls with different amounts or designs of marking may be used to train in stages. For example, a kit of balls for different stages is provided. The balls of different stages require different rates of rotation to appear visually similar to each other when thrown properly.

9 Claims, 4 Drawing Sheets

BALL MARKINGS FOR ROTATION TRAINING

BACKGROUND

The present invention relates to training a person to throw a ball with the proper rotation. At some point in development, a baseball or softball player learns to spin a ball as the ball is thrown.

Baseballs and softballs typically have a single color with or without a brand marking. For example, a baseball is yellow or white. The baseball is has two coverings held together with stitches. The stitches may be of the same color as the coverings or, more commonly, may have a different color. For example, red stitches are used on a white baseball. When thrown, the player may see the spin, in part, due to the stitches. However, it is difficult to judge proper rotation, especially for someone just learning to throw.

BRIEF SUMMARY

By way of introduction, the preferred embodiments described below include balls, kits, and methods for rotation training. A marking is positioned on the ball to enhance viewing of rotation. The marking is in a contrasting color than the rest of the cover and covers at least a quarter of the outer surface of the ball. The stitches are colored to avoid interfering with the visual effect of the marking, such as having stitches with similar coloration to the non-marking portion of the ball. Balls with different amounts or designs of marking may be used to train in stages. For example, a kit of balls for different stages is provided. The balls of different stages require different rates of rotation to appear visually similar to each other when thrown properly.

In a first aspect, a ball is provided for rotation training. Stitches are on an outer surface of the ball. The stitches connect coverings of the ball together. A marking is on the outer surface. The marking and another region make up a majority of the outer surface. The marking is a different color than the other region and is at least one fourth of the outer surface. The marking is mostly on one half of the ball. The stitches in the other region have less contrast with the other region than with the marking.

In a second aspect, a kit of balls is provided for rotation training. A first ball is covered with first stitches and at least two first regions of first different colors. The two first regions cover a majority of the ball. The first stitches are of a substantially same color as one of the first different colors. A second ball is covered with second stitches and at least two second regions of second different colors. The two second regions cover a majority of the ball. The second stitches are of a substantially same color as one of the second different colors. A third ball is covered with third stitches and at least two third regions of third different colors. The two third regions cover a majority of the ball. The third stitches are of a substantially same color as one of the third different colors. A darker one of the third different colors covers less of the third ball than a darker one of the second different colors covers the second ball. The darker one of the second different colors covers less of the second ball than a darker one of the first different colors covers the first ball.

In a third aspect, a method is provided for training to throw a ball with rotation. A first baseball is thrown with a substantially first hemisphere contrasted by color with a substantially second hemisphere. A visual response of the first throwing is viewed where rotation of the first baseball appears to show both the first and second hemispheres stationary. Stitches of the first baseball are colored to prevent impairment of the visual response. A second baseball is thrown with a substantially first hemisphere contrasted by color with a substantially second hemisphere. The first hemisphere includes second spaces of the contrast by color. A visual response of the second throwing is viewed where rotation of the second baseball appears to show both the first and second hemispheres stationary. Stitches of the second baseball are colored to prevent impairment of the visual response. The rotation of the second baseball is rapid enough to prevent viewing of the second spaces.

The present invention is defined by the following claims, and nothing in this section should be taken as a limitation on those claims. Further aspects and advantages of the invention are disclosed below in conjunction with the preferred embodiments.

BRIEF DESCRIPTION OF SEVERAL VIEWS OF THE DRAWINGS

The components and the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

One or more stages of balls are provided. Each stage provides the thrower with immediate visual feedback as to a correct release and rotation. Markings on the balls are shaped and sized to require different rates of rotation for a similar visual response. One ball requires less rotation than another. The thrower progresses through the balls of different stages to learn proper rotation of the ball.

The markings rely on visual blurring caused by the rotation. More rapid rotation is required to make a marking with less area appear as a marking with more area. The visual contrast of the marking is used to teach rotation. To avoid reduction in the contrast, the stitches are a color similar to the body of the ball. The similarity of the color serves to eliminate any visual confusion relative to the offsetting color of the marking.

Figure 1A:
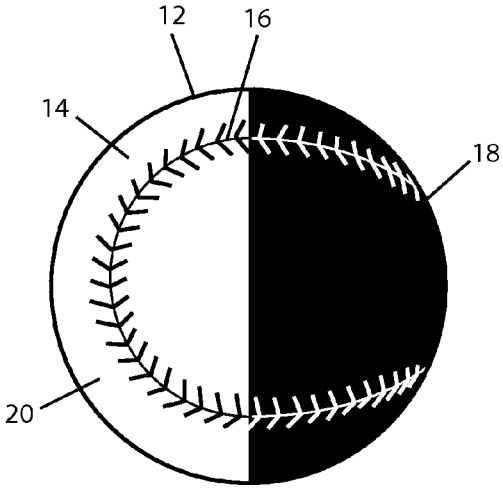
FIGS. 1A, 1B, and 1C show one embodiment of a ball with a marking viewed from three different directions.
Figure 1B:
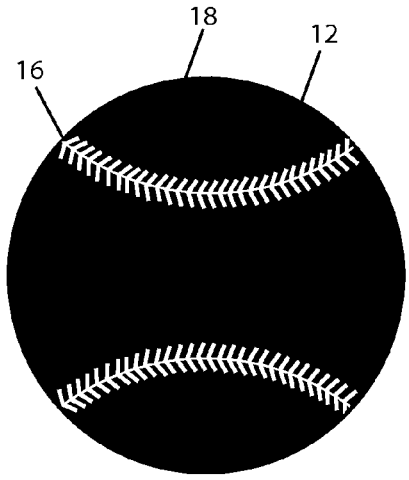
Figure 1C:
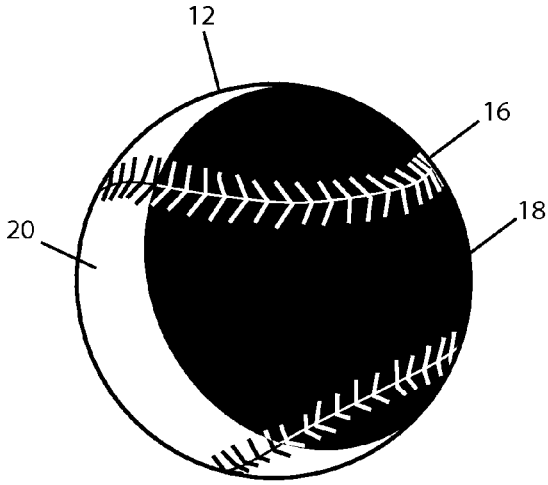

FIG. 1 shows one embodiment of a ball 12 for rotation training. The ball 12 is a baseball. Other types of balls 12 may be used, such as a softball. Any ball 12 to be thrown or kicked with rotation may be used.

The ball 12 includes an outer surface 14. For a spherical ball, the outer surface 14 is the outwardly visible portion of the ball 12. The outer surface 14 comprises two or more coverings held together with stitches 16. The outer surface 14 may or may not include writing or other information, such as brand marking.

The outer surface 14 also includes a marking 18. The marking 18 is a contiguous region, but may be a plurality of separate regions.

The marking 18 and another region 20 make up a majority or more (e.g., 75%, 80%, 90%, 95% or other amount) of the outer surface 14. The marking 18 and the other region 20 may make up the entire outer surface 14 other than the stitches 16, seam and any logo or text. The marking 18 and/or the other region 20 may include a brand, writing, or other visuals. This visual information is part of the other region 20 or marking 18, or may be considered a third region of different color taking up a relatively small percentage (e.g., 10% or less) of the outer surface 20.

The marking 18 is distinguishable from the other region 20 by being a different color. For example, the marking 18 is a shade of red. Other colors may be used, such as blue, black, green, orange, or bright yellow. The other region is substantially white or other color contrasting with the marking 18. Substantially is used to account for visible perception to a user of being white or contrast color or to allow for the color to be closer to white or the contrast color in perception than closer to the color of the marking.

The marking 18 has a contrasting color to the other region 20. The amount of contrast ranges from black and white (i.e., maximum possible visual contrast) to contrast modulation of 0.5 or greater. Less contrast modulation may be provided. The difference in luminance between the two colors is sufficient to be visually separate to a thrower. The contrasting colors may have similar luminance, but different chromaticity.

In one embodiment, the marking 18 covers at least one-fourth of the outer surface 14. The marking 18 may cover more or less of the outer surface 14. For example, the marking 18 in FIG. 1 covers mostly or all of one-half of the ball (e.g., covers one hemisphere). Mostly accounts for stitches, brands, symbols, text, or manufacturing tolerance away from exactly half. Mostly may account for +/−20% deviation from half in surface area. In one embodiment, the marking 18 covers one hemisphere of the outer surface 14. For example, the marking 18 is a red half and the other region 20 is a white half. By splitting the ball in half with two contrasting colors, a first stage ball for viewing any rotation is provided, even slow rotation.

To limit confusion, the stitches 16 of the other region 20 are a substantially same color as the color of the other region 20. Substantially is of visually similar shades of a same color or colors which are perceptually similar. In one embodiment, the stitches 16 are a color perceived as more similar to the other region 20 than the marking 18. When spinning, the stitches interfere less or not at all with perception of difference between the marking 18 and the other region 20. The stitches 16 may be the same color or different shade (hue) of the same color as the other region 20, such as white stitches in a white region.

Figure 2A:
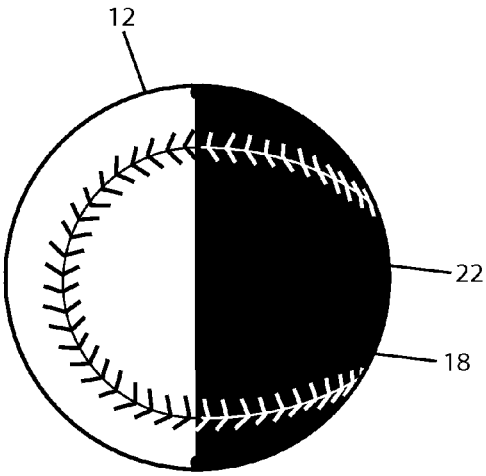
FIGS. 2A, 2B, and 2C show another embodiment of a ball with a marking viewed from three different directions.
Figure 2B:
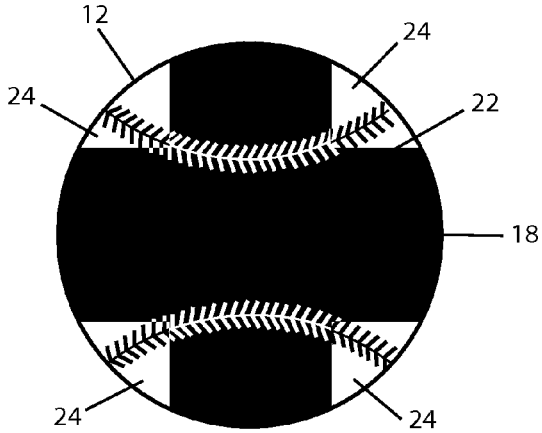
Figure 2C:
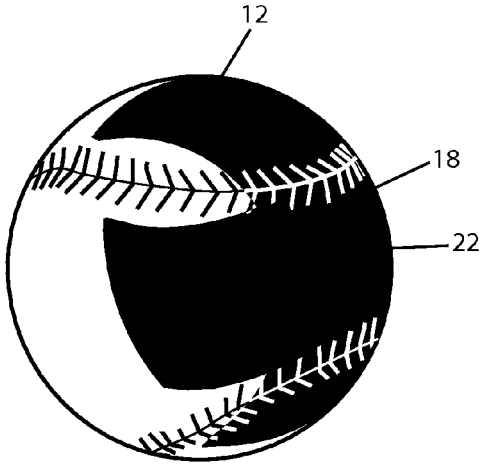

FIG. 2 shows three views of a different embodiment of the ball 12. The marking 18 has a different shape. The marking 18 is still mostly within a hemisphere, but does not cover the entire hemisphere. The marking 18 is a plus shape. For example, two strips of the same color intersect at a center 22 and extend away from the center 22 to an edge of the hemisphere. The strips are about half way around the ball 12. About accounts for +/−20% tolerance. In alternative embodiments, the stage two ball of FIG. 2 has two, three, five or other number of arms or extensions.

The stripes of the plus shape or the extensions from the center 22 are about 1.5 inches or greater in width. More narrow widths may be provided. The width may depend on the size of the ball 12.

The plus shape forms four areas or spaces 24 of the same color as the other region 20, but in the same hemisphere as the marking 18. The areas 24 are of any shape or size. Larger areas 24 require a more rapid rotation of the ball 12 to simulate the hemisphere being completely covered by the marking 18 as provided in the marking 18 of FIG. 1.

In one embodiment, the ball 12 of FIG. 2 is a stage two training ball. The utility of stage two combines the utility of stage one (FIG. 1) but adds an additional feature. The spaces 24 incorporated between the offsetting color require the thrower to release the ball with greater rotation speed to produce a similar visual response as stage one. The resulting benefit is greater velocity and accuracy of throws.

Figure 3A:
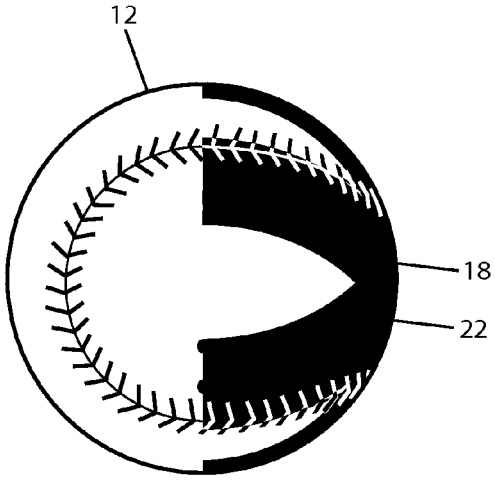
FIGS. 3A, 3B, and 3C show yet another embodiment of a ball with a marking viewed from three different directions.
Figure 3B:
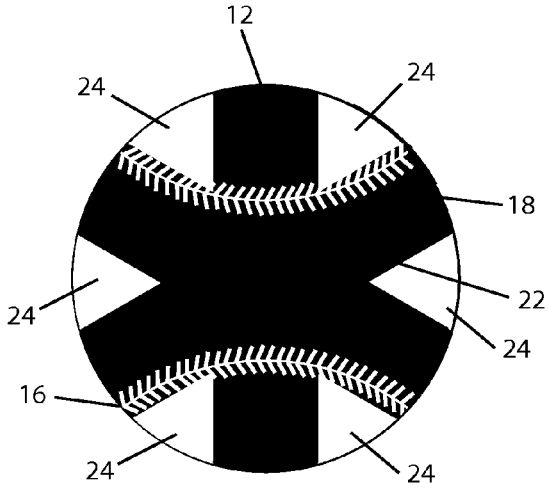
Figure 3C:
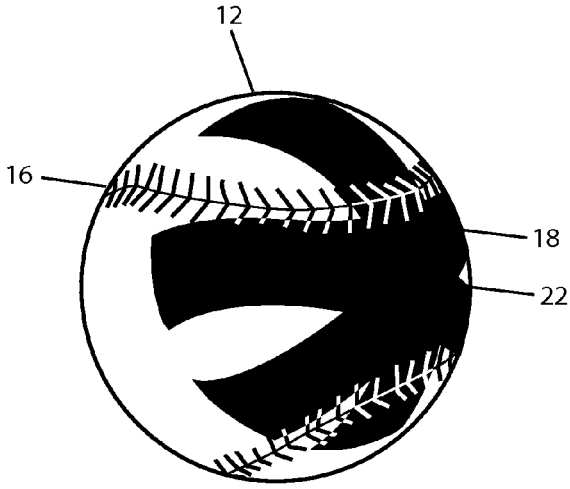

FIG. 3 shows another embodiment of the ball 12. Additional stripes or extensions from the center 22 are provided. Five or more extensions may be provided. Any number of extensions may be provided in any of the stages. The extensions from the center region are about one-third of the way around the ball 12. Two linear extensions and the center region are about one-half the way around the ball 12. In the example of FIG. 3, three stripes intersect at the center 22 to form six extensions in the hemisphere for the marking 18.

The stripes or extensions are less than two inches in width on a baseball, but wider stripes may be provided. The stripes for FIG. 3 are narrower than the stripes of FIG. 2, providing a greater total area of spaces 24 in the same hemisphere. Six spaces 24 of the same color as the other region 20 and in contrast with the color of the marking 18 are provided, but more or fewer spaces may be used. Different widths may be provided in addition to or as an alternative to changing the number of spaces 24.

The utility of this example stage three ball 12 is similar to the stage two ball of FIG. 2, except that the stage three ball 12 has more spaces and/or total area between the offsetting color of the marking 18. The greater amount of area or number of spaces 24 of the contrasting color to the marking 18 in the hemisphere of the marking 18 requires the thrower to have increased rotation speed along with the correct release of the ball 12 to achieve the desired visual feedback.

In the example embodiments of FIGS. 1-3, the marking 18 is symmetric about the stitches 16 on the ball 12. The marking 18 is symmetric, but may be unsymmetrical. The stitches 16 intersect the marking 18 at equal distances and alignment relative to the center 22 of the marking 18. In alternative embodiments, the marking 18 is not symmetric about the stitches 16.

The stitches 16 are on the outer surface 14 of the ball 12. The stitches 16 connect the coverings of the ball 12 together. Two or more coverings may be connected by the stitches 16. The stitches 16 are of any size, thickness, and extent across the seams. Any stitching pattern may be used. The stitches may be mostly hidden within the seam or are mostly exposed across the seam.

To avoid or limit visual impairment to viewing rotation, the stitches 16 have less contrast with the other region 20 than with the marking 18. Less contrast is based on visual perception, such as a measure of just noticeable differences. The relative contrast may be determined from the contrast modulation. The contrast modulation of the stitches 16 relative the color of the other region 20 is greater than relative to the marking 18. In one embodiment, the stitches 16 are of substantially the same color, hue, and/or shade as the color of the other region 20, such as the stitches 16 and other region 20 both being substantially white. Avoiding or limiting visual impairment may be provided by stitches 16 with similar color, shade, contrast or luminance to a viewer to the color of the other region 20 with or without reference to the color of the marking 18.

In the marking 18, the stitches 16 are the color of the other region 20, the same color as the stitches 16 in the other region 20, or a different color. In the embodiments of FIGS. 1-3, the stitches 16 are the same color over the entire ball 12. In alternative embodiments, the stitches 16 are substantially the same color as the region in which the stitches 16 are located. For example, the stitches 16 are white in the other region 20 and red in the marking 18.

Any one of the balls 12 of FIGS. 1-3 may be used alone. Two or more balls 12 may be packaged, sold, or used as a kit. For example, at least one ball 12 of each of the embodiments of FIGS. 1-3 are used together. As another example, two balls with different markings 18 are manufactured for use together. The manufactured balls 12 are to be used together for rotation training.

The balls 12 of the kit have substantially the same colors for the markings 18 and the other regions 20. For example, all of the balls have red (or shade of red) markings 18 and substantially white other regions 20 with substantially white stitches 16. The balls 12 may be different from each other in ways other than the markings 18, such as the color scheme being the same but with different colors. For example, different shades of red are provided for the different balls 12. In other embodiments, each stage of ball 12 uses different colors for the marking 18 and/or other regions 20.

The different stages have different amounts of marking 18 within the hemisphere for the marking 18. Balls 12 with less marking 18 in the hemisphere may require greater rotation speed to appear solid. For example, the darker marking 18 of the stage three ball 12 covers less of the ball 12 than the darker marking 18 covers the stage two ball 12, and the darker marking 18 of the stage two ball 12 covers less of the ball 12 than the darker marking 18 covers of the stage one ball 12. Alternatively, the marking 18 may be the lighter color.

In the embodiments of FIGS. 1-3, the marking 18 of the stage one ball 12 covers substantially the entire hemisphere. The marking 18 of the stage two ball 12 is within the hemisphere, but covers less of the hemisphere by having the extensions forming the spaces 24. The lighter color of the other region 20 extends into the hemisphere region of the marking 18. The marking 18 of the stage three ball is within the hemisphere, but has even more spaces 24 or area of the lighter color in the hemisphere. The area of the spaces 24 is greater in the stage three ball 12 than the stage two ball 12 and in the stage two ball 12 than the stage one ball 12. Alternatively or additionally, the number of extensions varies from fewer in the stage one ball to the most in the stage three ball. The marking 18 may or may not extend into the other hemisphere.

Figure 4:
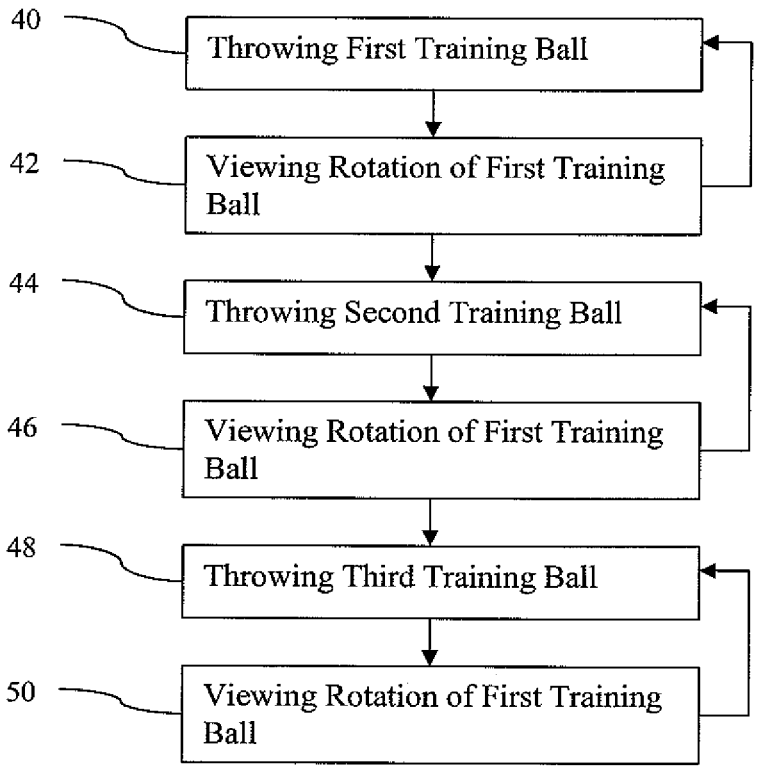
FIG. 4 is a flow chart diagram of an embodiment of a method for training to throw a ball with rotation.

FIG. 4 shows one embodiment of a method for training to throw a ball with rotation. Additional, different, or fewer acts may be provided. For example, only acts 40 and 42 are provided using any of the balls 12. As another example, only acts 40-46 are provided for using two of the balls 12.

In act 40, a first baseball is thrown. The baseball may be a stage one ball shown in FIG. 1. Substantially one hemisphere is contrasted by color with the other hemisphere. The baseball is thrown with a grip that would produce a "four-seam" fastball release. Other releases may be used.

In act 42, a visual response of the ball to the throwing of act 40 is viewed. If thrown properly, the ball rotates away or towards the thrower. The two contrasting hemispheres stay on the right and left halves as the ball travels. The rotation of the baseball appears to show both hemispheres as stationary, such as appearing as shown in the half and half view of FIG. 1 but with the stitches 16 blurred by rotation. When a red and white ball is thrown properly, the thrower and catcher see a visual image with one side of the ball white and the other side of the ball red. Undesired rotation or wobble causes the contrasting colors to mix or blur in at least a center region. This stage one ball trains the thrower to release the ball properly, thereby providing immediate visual response as to the correctness of the throw.

By having stitches with similar color as the lighter of the colors, the blur of the stitches rotation does not visually impair this visual response. Utilizing white stitches on a white ball may prevent impairment of the visual response when thrown properly.

In act 44, a different baseball is thrown. The baseball includes contrasting hemispheres or a marking substantially in one hemisphere contrasted by color with substantially another hemisphere. One or more spaces of contrast color are provided in the hemisphere with the marking. For example, the stage two ball of FIG. 2 is thrown.

In act 46, a visual response of the throwing of act 44 is provided. The rotation of the baseball appears to show both hemispheres stationary as stationary. To counteract the space, greater speed of end over end rotation is needed. The rotation is rapid enough to prevent viewing of the spaces. To obtain the desired visual response, the ball is thrown to spin faster. The stitches are colored to prevent impairment of the visual response.

In act 48, another baseball is thrown. The two hemispheres have contrasting color. The contrasting colors are on equal hemispheres or substantially entire hemispheres. The hemisphere with the marking includes even more spaces or amount of space.

In act 50, the visual response of the throwing of act 48 is viewed. Thrown properly, the rotation of the baseball appears to show both the first and second hemispheres stationary. To overcome the greater area or number of spaces, the rate of rotation is greater than needed in act 44. The rotation is rapid enough to prevent viewing of the spaces. The coloring of the stitches may prevent impairment of the visual response.

Any of the pairs of acts 40-42, 44-46, or 48-50 are repeated. The repetition allows the thrower to practice and achieve proper throwing mechanics.

A method of supply may be provided. Two or more balls with the different markings are made and supplied. The balls and corresponding markings are staged to train for increasing rotation.

While the invention has been disclosed above by reference to various embodiments, it should be understood that many changes and modifications can be made without departing from the scope of the invention. For example, the marking is used as the lighter color rather than the darker color.

It is therefore intended that the foregoing detailed description be understood as an illustration of the presently preferred embodiment of the invention, and not as a definition of the invention. It is only the following claims, including all equivalents that are intended to define the scope of this invention.

What is claimed is:

1. A training ball used for rotation training, the training ball comprising: a generally spherical ball having an outer surface;

a continuous stitching on the outer surface of the ball, said stitching defining a horseshoe-shaped boundary, the stitching connecting coverings of the ball together;

the ball including a first hemisphere and a second hemisphere, the first hemisphere including markings of a first color forming a first contiguous region covering at least one fourth of the ball's outer surface;

the first hemisphere further including a second region having a second color different than the first color, the second color of the second region intermittently distributed between the first color of the first contiguous region forming at least four adjacent areas on the first hemisphere;

wherein the stitching in the first hemisphere creates a greater contrast with the first color of the first region than with the second color of the second region.

2. The training ball of claim 1 wherein the first color is a shade of red and the second color is substantially white, the stitching in the second region being substantially white.

3. The training ball of claim 1 wherein the stitching is the same color as the first color in the first contiguous region, the stitching being a different color as a function of location relative to the first contiguous region and the second region.

4. The training ball of claim 1 wherein the stitching on the outer surface of the ball is formed of one color.

5. The training ball of claim 1 wherein the marking forms a plus shape of two overlapping stripes, each of the stripes of the plus shape extending about half way around the ball.

6. The training ball of claim 5 wherein the ball is a baseball and wherein each of the stripes is about 1.5 inches or greater in width.

7. The training ball of claim 1 wherein the marking comprises a shape having at least five extensions extending from a center of the marking by one third or less around the outer surface.

8. The training ball of claim 7 wherein the ball is a baseball and wherein the at least five extensions comprises six extensions formed by three stripes intersecting at the center of the marking, each of the stripes being around about one half of the ball and being less than two inches in width.

9. The training ball of claim 1 wherein the marking on the outer surface of the first hemisphere is symmetric about the stitching.

* * * * *